US009233285B2

(12) United States Patent
Masse

(10) Patent No.: US 9,233,285 B2
(45) Date of Patent: Jan. 12, 2016

(54) GOLF CLUB HOLDER

(71) Applicant: Darien Masse, Sherwood Park (CA)

(72) Inventor: Darien Masse, Sherwood Park (CA)

( * ) Notice: Subject to any disclaimer, the term of this patent is extended or adjusted under 35 U.S.C. 154(b) by 89 days.

(21) Appl. No.: 13/863,335

(22) Filed: Apr. 15, 2013

(65) Prior Publication Data

US 2014/0309053 A1 Oct. 16, 2014

(51) Int. Cl.

| | |
|---|---|
| ***A63B 55/10*** | (2006.01) |
| ***A63B 55/00*** | (2015.01) |
| *A63B 71/00* | (2006.01) |
| *A63B 57/00* | (2015.01) |
| *A63B 71/02* | (2006.01) |

(52) U.S. Cl.

CPC ..... *A63B 55/10* (2013.01); *A63B 55/00* (2013.01); *A63B 57/0068* (2013.01); *A63B 71/0036* (2013.01); *A63B 2071/024* (2013.01); *A63B 2225/68* (2013.01)

(58) Field of Classification Search

CPC ..... A63B 55/10; F16M 13/00; F16M 13/02; F16M 13/022

USPC ..... 473/286, 282; 211/70.2; D21/796; D6/552; 206/315.3, 315.2, 315.6, 206/315.4

See application file for complete search history.

(56) References Cited

U.S. PATENT DOCUMENTS

| | | | | |
|---|---|---|---|---|
| 699,391 | A | 5/1902 | Johnson | |
| 2,577,333 | A | 12/1951 | Klum | |
| D186,029 | S | 9/1959 | Sasaki | |
| D200,417 | S | 2/1965 | Miele | |
| 3,219,083 | A | 11/1965 | Asquith | |
| D222,720 | S | 12/1971 | Lapham | |
| D232,449 | S | 8/1974 | Herring | |
| D237,396 | S | 10/1975 | Herring | |
| 3,954,239 | A | 5/1976 | Kerbs, Jr. | |
| D284,907 | S | 8/1986 | Wiedeman | |
| 5,217,380 | A * | 6/1993 | Martinet | 434/252 |
| 5,417,334 | A * | 5/1995 | Wu | 211/70.2 |
| D360,451 | S | 7/1995 | Levocz | |
| 5,474,191 | A * | 12/1995 | Bergeron et al. | 211/70.2 |
| 5,634,616 | A * | 6/1997 | Wang et al. | 248/96 |
| D384,500 | S | 10/1997 | Muench | |
| 5,743,809 | A * | 4/1998 | Lehman | 473/300 |
| 6,311,938 | B1 * | 11/2001 | Lin | 248/96 |
| 6,345,722 | B1 * | 2/2002 | Wingate | 211/70.2 |
| 6,383,088 | B1 | 5/2002 | Kershner | |
| 6,464,076 | B2 * | 10/2002 | Tan | 206/315.6 |
| D480,870 | S * | 10/2003 | Wampler et al. | D3/255 |
| 6,786,835 | B1 * | 9/2004 | Carter | 473/300 |
| 6,892,773 | B1 * | 5/2005 | Wenzler | 150/159 |
| 6,939,243 | B1 * | 9/2005 | Mitchell et al. | 473/227 |
| 8,414,416 | B1 * | 4/2013 | Edwards | 473/286 |
| 8,439,768 | B1 * | 5/2013 | Shah | 473/282 |
| 2004/0198527 | A1 * | 10/2004 | Hsieh | 473/282 |
| 2007/0219015 | A1 * | 9/2007 | Gazeley | 473/300 |
| 2011/0070967 | A1 * | 3/2011 | Davis, Jr. | 473/282 |
| 2011/0215013 | A1 * | 9/2011 | Young et al. | 206/315.2 |
| 2013/0029774 | A1 * | 1/2013 | Davis, Jr. | 473/282 |
| 2014/0069059 | A1 * | 3/2014 | Scott | 53/416 |

* cited by examiner

*Primary Examiner* — Stephen Blau

(74) *Attorney, Agent, or Firm* — Christensen O'Connor Johnson Kindness PLLC

(57) ABSTRACT

A golf club holder includes an elongate body having a first end and a second end. A ground engaging member is positioned at the first end, whereby the elongate body is supported in a ground surface in a substantially vertical orientation. A socket is provided for detachably securing a first end of at least one golf club spaced from the first end of the elongate body. A clamp is provided for detachably securing a second end of the at least one golf club spaced from the second end of the elongate body.

8 Claims, 7 Drawing Sheets

GOLF CLUB HOLDER

TECHNICAL FIELD

The present document relates to a golf club holder.

BACKGROUND

There are very few golfers who are sufficiently skilled to consistently place a golf ball onto a golf green from a distance. Usually a golfer's fairway shoot will land in the vicinity of the green. The golfer will then use a pitching wedge to pitch the golf ball onto the green and then a putter to putt the golf ball into the hole. This requires a golfer to withdraw both his pitching wedge and his putter from his golf bag as he approaches the green. The golfer must place his putter onto the ground when making a shot with his pitching wedge, and then must place his pitching wedge on the ground when using his putter. There are a number of problems inherent in placing clubs onto the ground. One problem is the danger that the club will be inadvertently left behind. Another problem is sorting out, as between the golfers in a foursome, which club is whose. Yet another problem is the danger that the club will be accidentally stepped on resulting to injury to the golfer or damage to the club.

In order to address some of these problems, golf club holders have been developed. One example of such a golf club holder is sold under the Trade Name "GOLF BUTLER." This golf club holder is in the form of a shaft with a handle at one end and a ground engaging spike at the other. Extending transversely in relation to shaft is a member with a plurality of notches. A golfer rests a head of his golf club on the ground and then places a handle of the golf club into one of the notches with the golf club leaning up against the transverse member.

SUMMARY

A golf club holder comprises a shaft with a ground engaging base; golf club retainers radially spaced about the shaft; and sockets radially spaced at or near the ground engaging base about the shaft and each shaped to receive and wedge a handle end of a golf club.

According to the present disclosure there is also provided a golf club holder which includes an elongate body having a first end and a second end. A ground engaging member is positioned at the first end, the ground engaging member being oriented to support the elongate body in a ground surface in a substantially vertical orientation. Means are provided for detachably securing a first end of at least one golf club spaced from the first end of the elongate body. Means are also provided for detachably securing a second end of the at least one golf club spaced from the second end of the elongate body.

The golf club holder, as described above, securely holds one or more golf clubs. The golf clubs are held at both their first or grip end and their second or head end.

Although beneficial results may be obtained through the use of the golf club holder, as described above, golfers are accustomed to carrying their golf clubs in a golf bag. Even more beneficial results may, therefore, be obtained when a removable storage tube is provided that overlies both the elongate body and the at least one golf club secured to the elongate body. This enables the tube to be positioned in a golf bag, and the golf club holder and attached club or clubs to be withdrawn as a unit.

Although beneficial results may be obtained through the use of the golf club holder, as described above, it is preferable that the golf club holder be able to accommodate both a pitching wedge and a putter, rather than either a pitching wedge or a putter. Even more beneficial results may, therefore, be obtained when the means for detachably securing a first end of at least one golf club can accommodate a first golf club and a second golf club and the means for detachably securing a second end of the at least one golf club can accommodate the first golf club and the second golf club.

Although beneficial results may be obtained through the use of the golf club holder, as described above, even more beneficial results may be obtained when a hand grip is provided at the second end of the elongate body. The hand grip makes it easier to withdraw the golf club holder from the golf bag.

There are various means that can be used to detachably secure a golf club to the elongate body. It is preferred that the means for detachably securing a first end of at least one golf club spaced from the first end of the elongate body is a first member having a golf club accommodating socket. It is preferred that the means for detachably securing a second end of the at least one golf club is at least one clamp.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
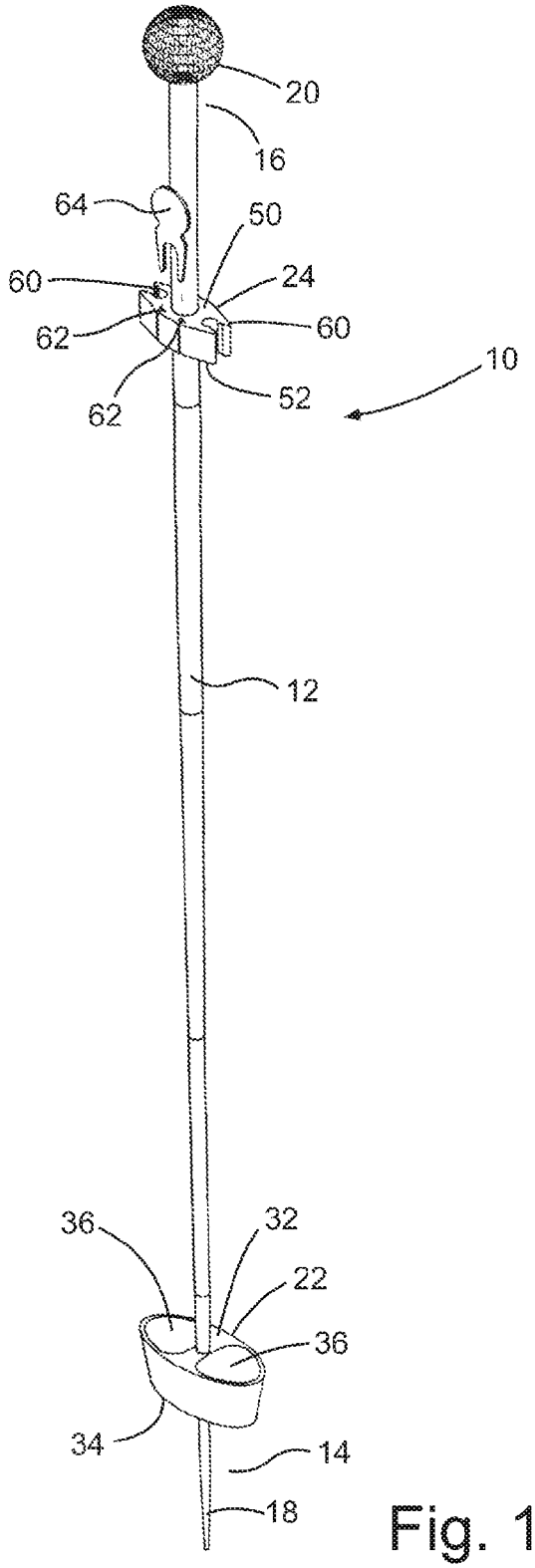
FIG. 1 is a perspective view of a golf club holder constructed in accordance with the teachings of the present document.

The preferred embodiment, a golf club holder, generally identified by reference numeral 10, will now be described with reference to FIGS. 1 through 11.

Referring to FIG. 1, golf club holder 10 includes a shaft, for example an elongate body 12. The body 12 may have a ground engaging base, for example first end 14, and a handle end, for example second end 16. First end 14 is terminated with a ground engaging spike 18. A hand grip 20 such as a grip having a ball shape as shown is attached to second end 16. A first member 22 such as sockets 36 is spaced from first end 14 of elongate body 12. A second member 24 such as a pair of golf club retainers or clamps 60 as shown, is spaced from second end 16 of elongate body 12.

Figure 2:
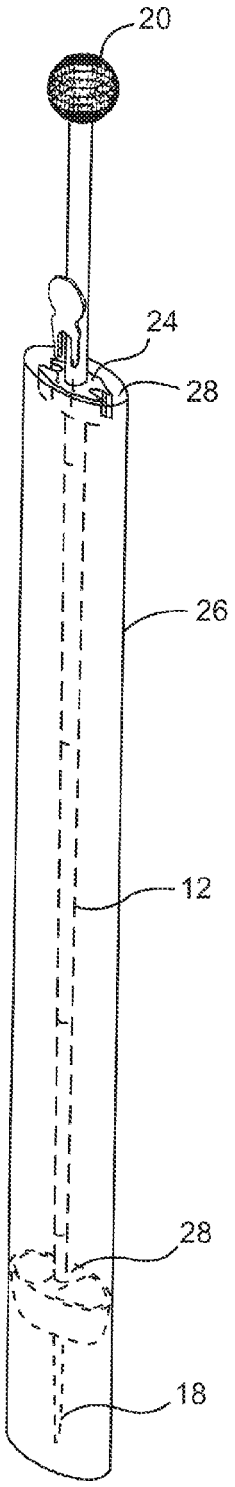
FIG. 2 is a perspective view of the golf club holder illustrated in FIG. 1, with storage sleeve.
Figure 3:
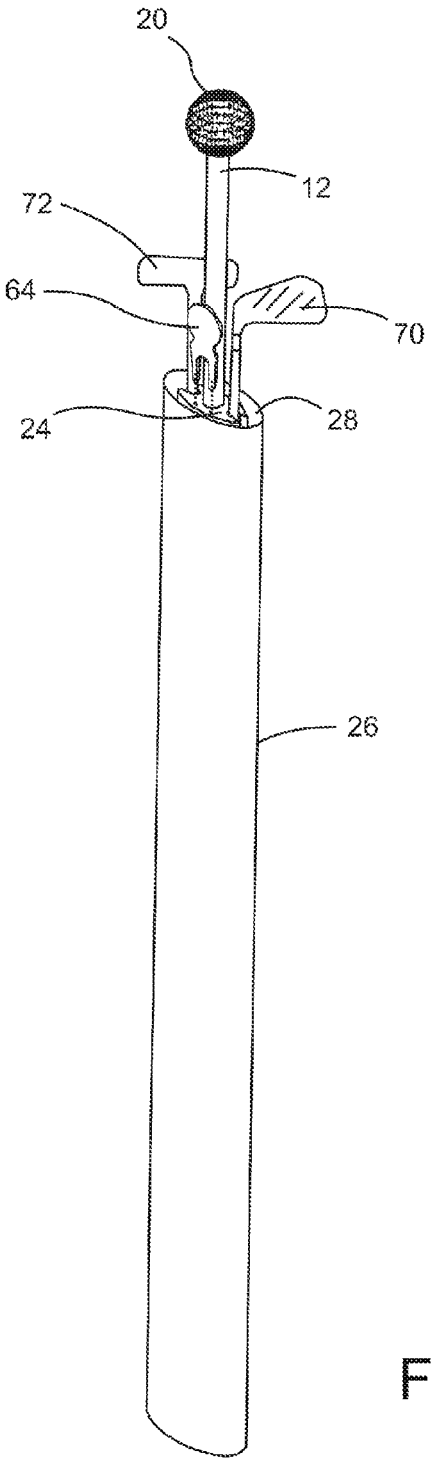
FIG. 3 is a perspective view of the golf club holder and storage sleeve illustrated in FIG. 2, with a pitching wedge and a putter secured to the golf club holder.
Figure 4:
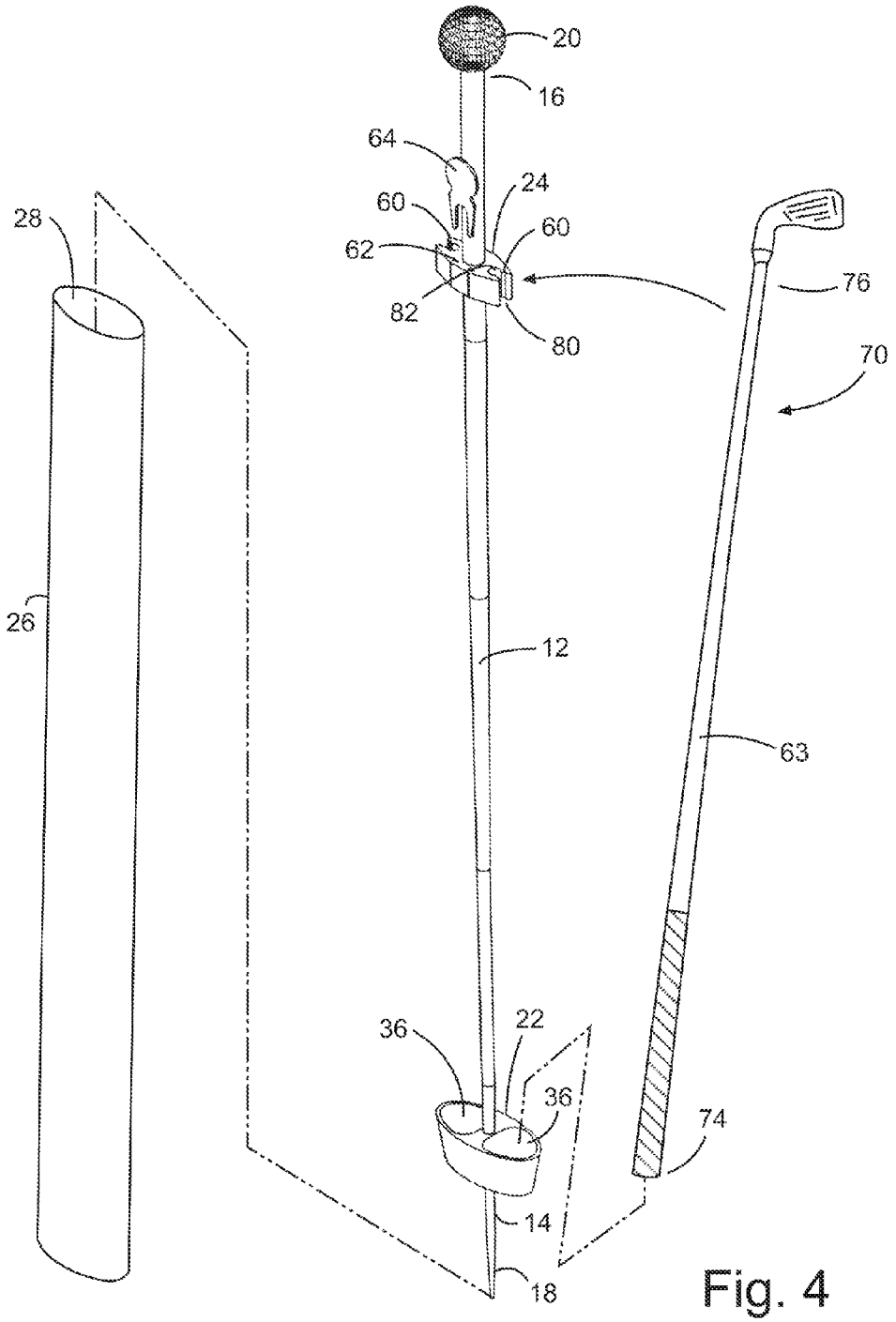
FIG. 4 is an exploded perspective view of the golf club holder illustrated in FIG. 1, with storage sleeve and pitching wedge.

Referring to FIGS. 2 through 4, a removable storage tube 26 fits loosely over elongate body 12, first member 22 and second member 24. Storage tube 26 is an open ended substantially oval cylinder which is intended to separate golf club holder 10 from clubs in a golf bag (not shown). Referring to FIG. 3, a length of storage tube 26 is sufficient to receive substantially the entire length of a shaft 68 of a golf club, as is illustrated with a pitching wedge 70 and a putter 72. Storage tube 26 has an opening 28 sized to allow first elongate body 12 to be withdrawn with pitching wedge 70 and putter 72 attached.

Figure 5:
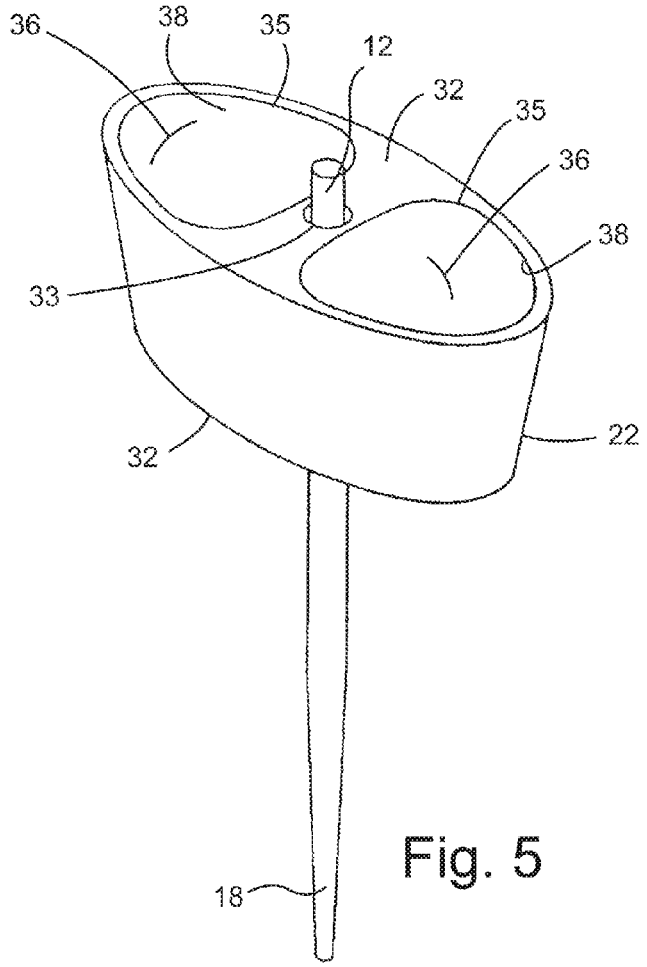
FIG. 5 is a detailed perspective view of a socket for the golf club holder illustrated in FIG. 1.
Figure 6:
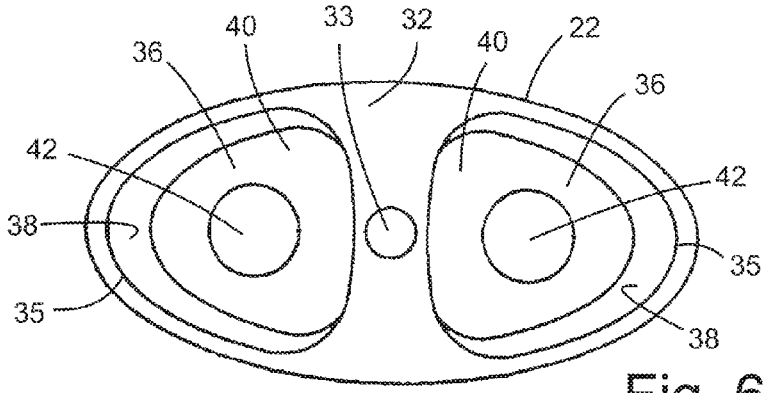
FIG. 6 is a detailed top plan view of the socket for the golf club holder illustrated in FIG. 5.

Referring to FIGS. 5 and 6, first member 22 is substantially oval in horizontal cross section, and has a substantially planar top 32 and a substantially planar bottom 34. A circular hole 33 extends throughout the height of first member 22 and is sized to closely accommodate elongate body 12. A pair of golf club accommodating sockets 36 are accessed by an opening, a rim of which is indicated by reference numeral 35, in top 34 of first member 22. The sockets 36 are radially spaced at or near the second end 16 about the body 12. Each socket 36 has a circumferential sidewall 38 and a base 40. Each socket 36 is shaped to receive and wedge a handle end of a golf club. For example, two or more interior sidewalls, or portions of sidewalls such as the interior surfaces of circumferential sidewall 38, converge for example slightly toward base 40, in a direction from socket opening 35 to a socket base 40. The interior, for example sidewall 38, of each socket 36 has a non circular shape in a cross sectional plane defined perpendicular to a socket axis running from opening 35 to base 40. The non circular shape is a polygonal shape, for example a triangular shape as shown, with rounded corners and rounded sides, in the cross sectional plane. Thus, as the golf club handle is axially inserted into the socket, the handle wedges into a friction fit against tapered sidewall 38 to restrict rotation of the club while the club is held by the holder 10. Referring to FIG. 4, socket 36 is sized to accommodate a grip end 74 of a golf club and, in particular, pitching wedge 70 or putter 72. Referring to FIG. 6, each socket 36 has a hole 42 extending from base 40 through bottom 34 of first member 22 whereby any water or like material can drain from socket 36.

Figure 7:
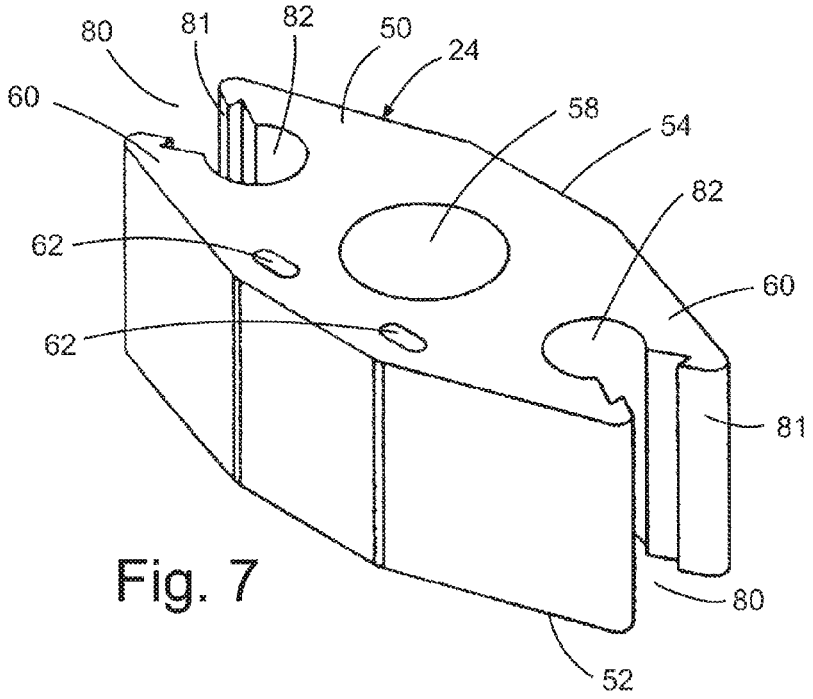
FIG. 7 is a detailed perspective view of a clamp for the golf club holder illustrated in FIG. 1.
Figure 8:
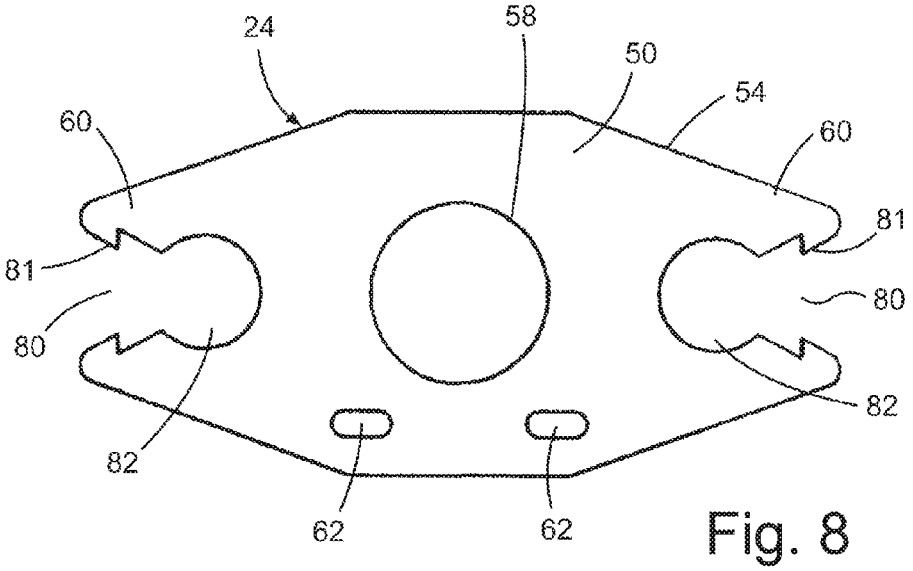
FIG. 8 is a detailed top plan view of the clamp for the golf club holder illustrated in FIG. 7.
Figure 11:
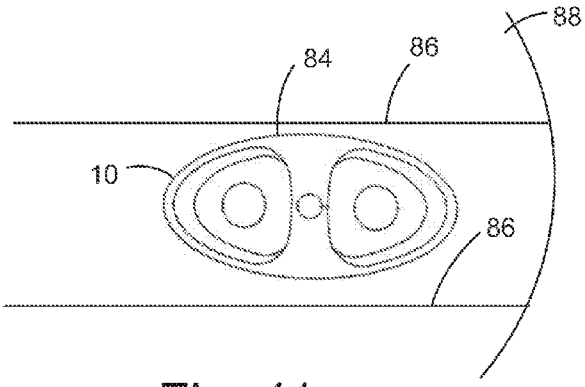
FIG. 11 is a top plan view of the golf club holder inserted in between adjacent partitions of a golf club bag.

Referring to FIGS. 7 and 8, second member 24 has a top face 50 and a bottom face 52 and a peripheral sidewall 54. A circular hole 58 extends through second member 24 from top face 50 to bottom face 52, which is sized to closely accommodate elongate body 12. A pair of opposed golf club accommodating clamps 60 are positioned along peripheral sidewall, for example radially spaced at diametrically opposite positions about the body 12. Each clamp 60 is axially aligned with a respective socket 36 (FIG. 1). Each clamp has a guide channel 80 into a holding cavity 82 defined by a pair of resilient pincer members 81. A pair of holes 62 are provided in top face 50 to accommodate a divot repair tool 64, as illustrated in FIG. 4. Referring to FIG. 11, the holder 10 has a radial dimension profile 84 sufficiently narrow to permit insertion of the golf club holder 10 with attached golf clubs in between adjacent partitions 86 in a golf bag 88. Such a profile also allows a user to pull a club out of holder 10 while in bag 88.

Figure 9:
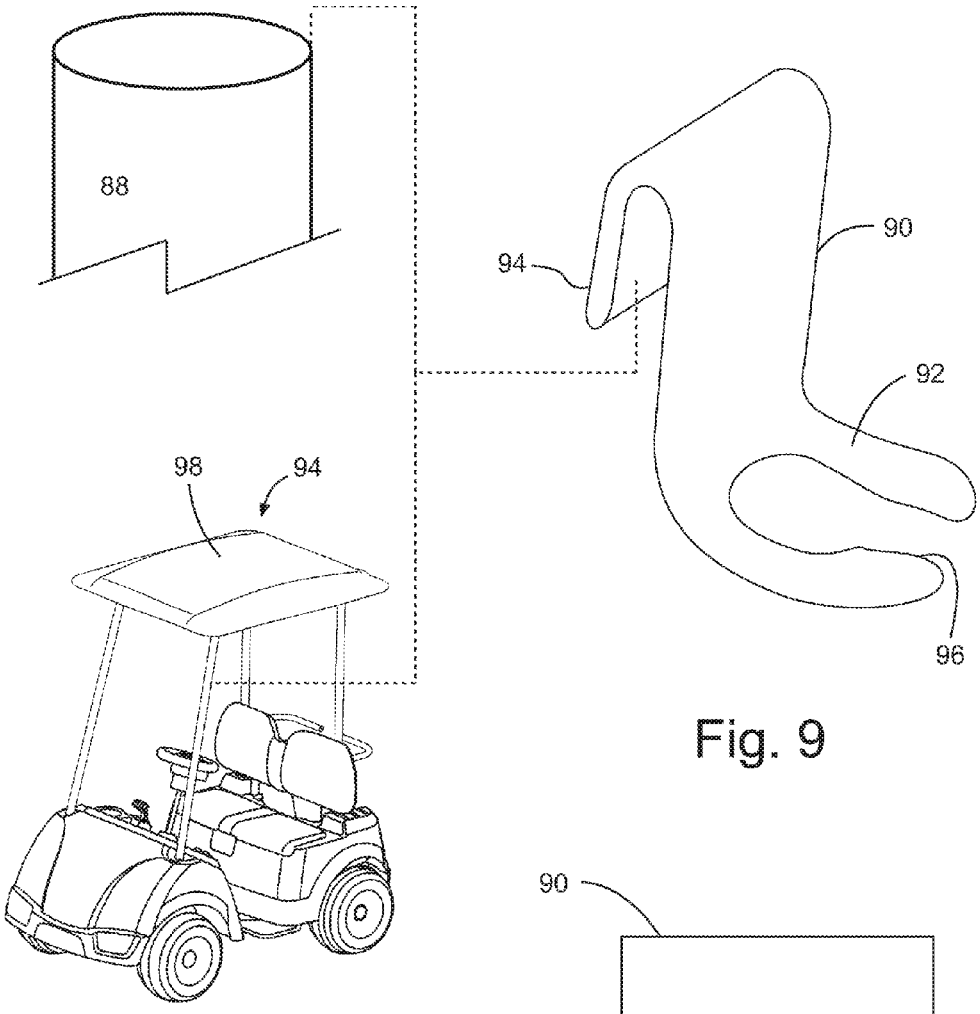
FIGS. 9 and 10 are perspective and front elevation views of a clip for the golf club holders disclosed here.
Figure 10:
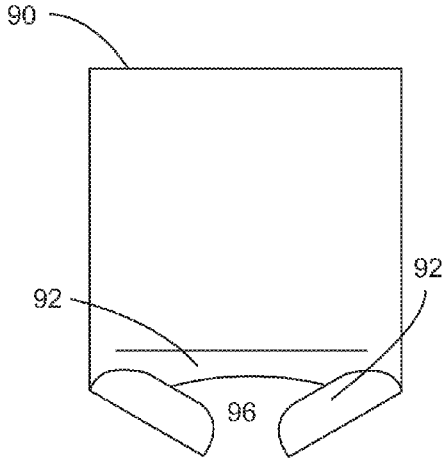

Referring to FIGS. 9 and 10, a bracket 90 is provided for holder 10. Bracket 90 has a retainer 92 for first end 12 of the holder 10, and a connector, such as a hook 94, for one or more of a golf cart 94 or golf club bag 88. The retainer 92 has a cup shape with a lateral slot 96 for receiving the body 12 of holder 10. The hook 94 is dimensioned to mount, for example through an additional bracket (not shown) onto the canopy 98 of the cart 94 in one case.

The use and operation of golf club holder 10 will now be described with reference to FIGS. 1 through 8. In order to demonstrate use of golf club holder 10 pitching wedge 70 and putter 72 are illustrated. Referring to FIGS. 2 through 4, removable storage tube 26 overlies the elongate body 12, pitching wedge 70 and putter 72. In order to remove golf club holder 10 from his golf bag (not shown) a golfer grasps hand grip 20 and removes elongate body 12 to which pitching wedge 70 and putter 72 are attached from storage tube 26. Referring to FIG. 4, the manner in which golf clubs are detachably secured to golf club holder 10 is illustrated with reference to pitching wedge 70. Pitching wedge 70 has shaft 68, grip end 74 and a head end 76. Grip end 74 of pitching wedge 70 is detachably secured to elongate body 12 by insertion into socket 36. Shaft 68 of pitching wedge 70 spaced a short distance from head end 76 is clamped in clamp 60, illustrated in FIG. 3. Head end 76 is inserted into clamp 60 by applying lateral force to shaft 68 so that head end 76 passes through opening 80 into holding cavity 82. Resilient pinchers 81 prevent shaft 68 from being removed until a force is applied. This maintains grip end 74 of pitching wedge 70 in socket 36 and detachably secures head end 76 of pitching wedge 70 to elongate body 12. When the golfer requires either putter 72 or pitching wedge 70 in order to make a shot, ground engaging spike 18 is driven into a ground surface to support elongate body 12 in a substantially vertical orientation. When the shot has been played the club is resecured to golf club holder 10 as described above, and golf club holder 10, pitching wedge 70 and putter 72 are reinserted into storage tube 26 as illustrated in FIG. 3. Golf club holder 10, pitching wedge 70 and putter 72, assembled as illustrated in FIG. 3, can be removably inserted into a golf club bag for storage or carrying with a plurality of other golf clubs in a set.

Immaterial modifications may be made to the embodiments described here without departing from what is covered by the claims. The embodiments disclosed here are not intended to be construed as limiting, even if absolute language is used such as element X is a Y.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A golf club holder, comprising:

a shaft with a ground engaging base;

golf club retainers radially spaced about the shaft; and sockets radially spaced at or near the ground engaging base about the shaft and each shaped to receive and wedge a handle end of a golf club;

in which each socket has an interior perimeter sidewall that, when viewed down a socket axis from a socket opening to a socket base, has a concave cross-sectional perimeter surface profile, and the concave cross-sectional perimeter surface profile converges with itself when moving in a direction from the socket opening to the socket base;

in which the concave cross-sectional perimeter surface profile of each socket has a non-circular shape.

2. The golf club holder of claim 1 in which the concave cross-sectional perimeter surface profile of each socket has a polygonal shape, with rounded corners and rounded sides.

3. The golf club holder of claim 2 in which the concave cross-sectional perimeter surface profile comprises three rounded corners and three rounded sides.

4. The golf club holder of claim 1 wherein the golf club retainers comprise a pair of golf club retainers and the sockets comprise a pair of sockets, with each golf club retainer being axially aligned with a respective socket, and each golf club retainer and socket being radially spaced at diametrically opposite positions about the shaft from the other golf club retainer and socket, respectively.

5. The golf club holder of claim 4 with a radial dimension profile sufficiently narrow to permit insertion of the golf club holder with attached golf clubs in between adjacent partitions in a golf bag.

6. The golf club holder of claim 1 further comprising a bracket with a retainer for a handle end of the shaft and a connector for one or more of a golf cart or golf club bag.

7. The golf club holder of claim 6 in which the connector is a hook, the handle end of the shaft has a ball shape, and the retainer has a cup shape with a slot for laterally receiving the shaft.

8. The golf club holder of claim 1 in which the ground engaging base is a spike.

* * * * *